United States Patent [19]

Finch

[11] Patent Number: 5,033,754

[45] Date of Patent: Jul. 23, 1991

[54] ALGEBRAIC EQUATION SOLVING CARD GAME

[76] Inventor: Kenneth B. Finch, 1919 E. Carmen St., Tempe, Ariz. 85283

[21] Appl. No.: 587,046

[22] Filed: Sep. 24, 1990

[51] Int. Cl.[5] ..... A63F 1/00; G09B 19/22; G09B 19/00

[52] U.S. Cl. ..... 273/299; 434/209

[58] Field of Search ..... 273/299, 272; 434/209, 434/188

[56] References Cited

U.S. PATENT DOCUMENTS 4,029,320 6/1977 Hausman ..... 273/249

4,281,835 8/1981 Seiden ..... 273/299

*Primary Examiner*—Benjamin Layno

*Attorney, Agent, or Firm*—Cahill, Sutton & Thomas

[57] ABSTRACT

Card game apparatus and method of play involve the systematic solution of algebraic equations. The apparatus includes an algebraic equation and a set of cards having indicia denoting the mathematical operations of "multiply", "divide", "add X's", "subtract X's", "add constant", and "subtract constant". Players are dealt cards and take turns modifying the equation by performing mathematical operations directed by cards they hold. The person who solves the equation is the winner. Play money may be used to keep score.

10 Claims, 1 Drawing Sheet

ALGEBRAIC EQUATION SOLVING CARD GAME

TECHNICAL FIELD

This invention relates to a game which enables persons to demonstrate and learn the skill of solving algebraic equations.

BACKGROUND ART

Numerous games have been invented to test a persons knowledge of and to teach arithmetic. Representative examples of such games are disclosed in the following U.S. Pat. No. 660,004, granted Oct. 16, 1900, to Edward Christie for "Game Apparatus" discloses a game utilizing a set of cards containing numerals and mathematical symbols. Players endeavor to combine cards on a playing surface into mathematical equations, producing a number which matches a number on one of the cards in the players hand.

U.S. Pat. No. 2,198,670, granted Apr. 30, 1940, to C.M. Johnson, for "Game Piece" describes a game utilizing a set of game pieces containing numerals and mathematic symbols for plus, minus, multiply, divide, and equal. These pieces are to be deployed on a playing surface to create correct mathematical equations.

U.S. Pat. No. 4,281,835, granted Aug. 4, 1981, to Nat Seiden for "Arithmetic Card Game Method" discloses a method of playing a mathematical game utilizing one set of cards having numerals imprinted thereon and a second set of cards with mathematical symbols imprinted thereon. Symbol cards are distributed on a playing surface and numeral cards are dealt to the players. The players endeavor to create correct mathematical equations utilizing both sets of cards according to various rules of play.

The games disclosed in these patents test and possibly improve a players skill in performing simple arithmetic involving addition, subtraction, multiplication and division, but they do not require much skill or mental effort. Consequently, players can easily tire of and lose interest in such games.

DISCLOSURE OF THE INVENTION

The game of this invention actually tests players skills in solving algebraic equations which can be simple or complex, depending upon the level of play desired.

Players of the game set about solving an algebraic equation containing an unknown, "X". The players are dealt cards from a set of operation cards having printed thereon indicia representing the mathematical operations of "multiply", "divide", "add X's", "subtract X's", "add constant", and "subtract constant". These are the basic operations employed in solving algebraic equations. The players "play" individual operation cards in turn, performing the operation on the selected equation which is directed or indicated by that card. Play continues until one player performs the final operation, which provides a solution to the equation, namely, the value of the unknown, "X". That person is declared the "winner" of that round of equation solving.

The invention contemplates that the players may be provided with play money as a means of keeping score as the game progresses through several rounds of equation solving.

BRIEF DESCRIPTION OF THE DRAWING

The invention is described in greater detail hereinafter by reference to the accompanying drawings, wherein.

BEST MODE FOR CARRYING OUT THE INVENTION

Figure 1:
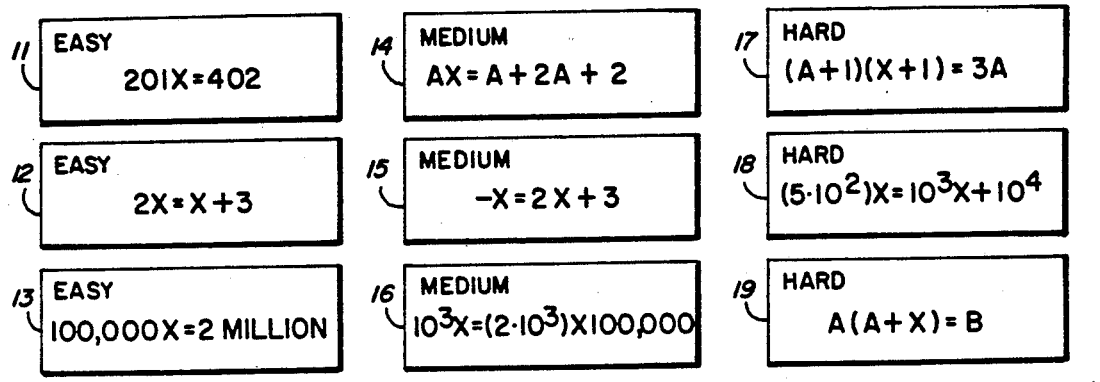
FIG. 1 depicts a set of algebraic equations to be solved in playing the game.
Figure 2:
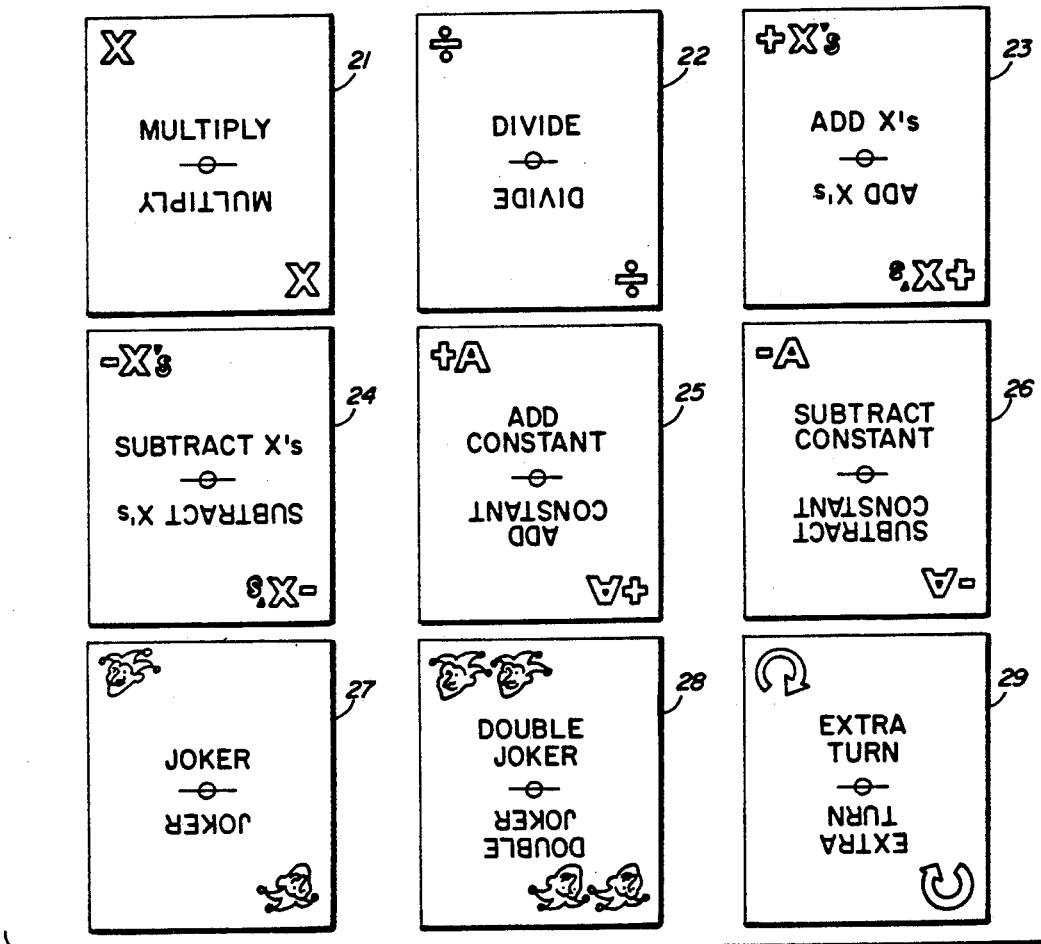
FIG. 2 depicts different operation cards utilized in the game.

This invention comprises game apparatus and a method of play by which the players endeavor to solve a selected algebraic equation. The principal apparatus utilized is a selected algebraic equation, representative ones of which are shown in FIG. 1, and a set of operation, or calculation, cards, representative ones which are shown in FIG. 2. The object of the game is to solve an algebraic equation by performing the mathematical operations indicated by the indicia on the respective operation cards of FIG. 2

A set of individual equation cards may be provided as indicated in FIG. 1, or a set of such equations may be imprinted on a single sheet, or one of the players may conceive and write down his own equation.

It is preferred that if preprinted equations are provided, the carrier material be plastic or plastic-coated paper or paperboard for durability during handling and use.

It will further be noted from FIG. 1 that the equations may be graded as to degree of difficulty of solution. Equations 11, 12, and 13 are depicted as "EASY" to solve. Equations 14, 15, and 16 are of "MEDIUM" difficulty. And, equations 17, 18, and 19 are "HARD" to solve. The level of skill required to play the game can thus be adjusted through selection of equations of different degrees of difficulty.

The set of operation playing cards represented in FIG. 2 comprises six different mathematical operations which are required to solve any algebraic equation and may comprise three other different operation cards as well.

The six required operation cards are as follows:

"MULTIPLY" card 21 has indicia printed thereon indicating that the player holding that card may multiply both sides of an equation by any constant or any number of unknowns (X's) or perform any indicated multiplication within an equation;

"DIVIDE" card 22 has indicia printed thereon indicating that its holder may divide both sides of an equation by any constant or any number of unknowns (X's) or perform any indicated division within an equation;

"ADD X's" card 23 has indicia indicating that its holder may add any positive number of unknowns (X's) to both sides of an equation or perform any indicated addition of unknowns within an equation;

"SUBTRACT X's" card 24 bears indicia indicating that its holder may subtract any positive number of unknowns (X's) from both sides of an equation or perform any indicated subtraction of unknowns within an equation;

"ADD CONSTANT" card 25 indicates that its holder may add any positive number to both sides of a equation or to perform any indicated addition of numbers in an equation; and "SUBTRACT CONSTANT" card 26 indicates that its holder may subtract any positive number from both sides of an equation or perform any indicated subtraction of numbers in an equation.

These six operation cards, 21–26, are required for playing the game of this invention to solve all algebraic equations which might be involved. A normal set, or deck, of operation playing cards will contain a plurality of each of the different operation cards, 21–26. The exact number of each is determined by the number of people who are expected to play the game. A deck of 48 such cards, or eight of each operation, is sufficient for play by four players.

The game can be made more interesting by incorporating optional "multiple operation" cards in the playing card set. The set depicted in FIG. 2 includes three such cards, one, some, or all of which may be included in the game apparatus. These optional cards are:

"JOKER" card 27, allows its holder to perform any one of the six mathematical operations indicated by cards 21–26 or perform any one mathematical operation within an equation;

"DOUBLE JOKER" card 28, allows its holder to perform any two of the six mathematical operations indicated by cards 21–26 or perform any two indicated mathematical operations in an equation, all in one turn; and "EXTRA TURN" card 29, allows a holder to perform two operations in one turn, such as play any one operation card 21–26, discard that card and the EXTRA TURN card, draw two new cards, and play any one additional operation card.

All the cards are preferably made of a durable material, such as plastic or plastic-coated paper or paperboard.

The basic rules of play utilizing the apparatus of FIGS. 1 and 2 generally are as follows, although there can be variations within the scope of the invention.

The players designate by any mutually agreeable means one player to serve as "gamemaster" for play to solve one equation. The gamemaster selects one of the equations 11–19 or writes his own equation on a piece of paper and places the selected equation on a playing surface in full view of all the players. The gamemaster then deals a predetermined number, preferably five, operation cards to each of the other players. The remaining operation cards are placed face down on the playing surface in a draw stack accessible to all players.

Play proceeds to the left of the gamemaster in a clockwise direction with each player in turn endeavoring to "play" one of his operation cards and perform the operation indicated thereon to modify the equation toward a solution. For example, a game seeking solution to equation 15, namely $-x=2X+3$ might proceed as follows:

Player A—would like to subtract 2X from both sides of the equation, but has no "SUBTRACT X" card. He discards an "ADD CONSTANT" card and draws a new card from the draw stack. This completes his turn.

Player B—has a "SUBTRACT X's" card and plays it and indicates that he is subtracting 2X from both sides of the equation and the modified equation now reads $-3X=+3$. He draws another card.

Player C—would like to divide both sides of the equation by $-3$ but has no "DIVIDE" card. He does have and plays a "MULTIPLY" card to multiply both sides of the equation by $-1$. He announces that the further modified equation now reads $3X=-3$. He draws another card.

Player D—has a "DIVIDE" card and plays it to divide both sides of the equation by three, announcing that the solved equation now reads $X=-1$.

The gamemaster verifies the correctness of the solution and declares Player D the winner of this round. Player D becomes gamemaster for the next round of equation solving and play is repeated.

Figure 3:
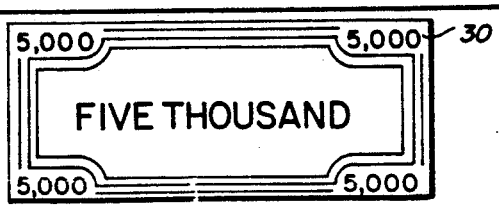
FIG. 3 depicts play money which may be used to keep score in a game.

If desired, play money may be used to score the game through several equation solving rounds to identify the overall winner of the game. A bank can be created of a stack of play money bills printed to represent dominations of, say, $5,000 each (see bill 30 in FIG. 3). The gamemaster has charge of the bank and at the commencement of the game provides each player with a predetermined amount of money, say $60,000. Each player antes $5,000 to create a "pot" at the beginning of each equation-solving round of play and each player may also be required to put an additional $5,000 into the pot with each play of an operation card from his hand. The winner of each equation-solving round takes the pot. The player with the most money at the end of a set period of play is the overall winner.

The gamemaster of each equation-solving round is not eligible to win the pot but may be compensated from the bank for successfully monitoring the equation solving sequence of play in his round. And, the gamemaster should be compensated in accordance with the degree of difficulty of solution of the equation he selects because the more difficult the solution, the more difficult it is for him to monitor and determine the correctness of the several equation modifying operations. For example, the gamemaster may be eligible to receive $10,000 for successfully monitoring solution to an "EASY" equation, $20,000 for a "MEDIUM" equation, and $30,000 for a "HARD" equation. The gamemaster is, of course, controlling the level of skill required to play his equation-solving round through the selection of a "EASY", "MEDIUM", or "HARD" equation.

There are a number of embellishments which can optionally be provided by inclusion in the rules of play. For example, players can be financially penalized for playing an inappropriate operation card or incorrectly stating how the modified equation reads, or for claiming incorrectly to have solved the equation. A player who loses all his money may borrow money from the bank to be paid back with interest, depending upon how long the borrowed money is kept.

It should be apparent from the foregoing that the invention provides an interesting and challenging game for the entertainment and enlightenment of persons interested in algebra.

What is claimed is:

1. Game apparatus comprising an algebraic equation containing an unknown, "X," therein, and a set of playing cards having indicia imprinted thereon directing the performance of one of the following mathematical operations:

Multiply
Divide
Add "X's"
Subtract "X's"
Add constant
Subtract constant;

said mathematical operations representing all possible operations capable of being performed on any algebraic equation of said set and any other algebraic equation containing an unknown "X";

said set containing at least one card depicting each of said mathematical operations.

2. The game apparatus of claim 1, wherein said set contains multiple cards depicting each of said mathematical operations.

3. The game apparatus of claim 1, wherein said set of playing cards contains at least one card having indicia thereon directing the performance of more than one of said mathematical operations.

4. A method of playing a game utilizing the game apparatus of claim 3, comprising the steps of dealing a plurality of said playing cards to a plurality of players and permitting each player, in turn, to play an appropriate one of his cards and perform the mathematical operation directed thereby on said equation until the equation is solved to indicate the value of the unknown.

5. A method of playing a game utilizing the game apparatus of claim 1, comprising the steps of dealing a plurality of playing cards to a plurality of players and permitting each player, in turn, to play an appropriate one of his cards and perform the mathematical operation directed thereby on said equation until the equation is solved to indicate the value of the unknown.

6. Game apparatus comprising a set of algebraic equations, each containing an unknown, "X", therein, and a set of playing cards having indicia imprinted thereon directing the performance of one of the following mathematical operations:

Multiply
Divide
Add X's
Subtract X's,
Add constant
Subtract constant;

said mathematical operations representing all possible operations capable of being performed on any algebraic equation of said set and any other algebraic equation containing an unknown "X";

said set of playing cards containing at least one card depicting each of said mathematical operations.

7. The game apparatus of claim 4, wherein said set contains multiple cards depicting each of said mathematical operations.

8. The game apparatus of claim 6, wherein said set of playing cards contains at least one card having indicia thereon directing the performance of more than one of said mathematical operations.

9. A method of playing a game utilizing the game apparatus of claim 8, comprising the steps of selecting one of said algebraic equations, dealing a plurality of said playing cards to a plurality of players and permitting each player, in turn, to play an appropriate one of his cards and perform the mathematical operation directed thereby on said equation until the equation is solved to indicate the value of the unknown.

10. A method of playing a game utilizing the game apparatus of claim 6, comprising the steps of selecting one of said algebraic equations, dealing a plurality of said playing cards to a plurality of players and permitting each player, in turn, to play an appropriate one of his cards and perform the mathematical operation directed thereby on said equation until the equation is solved to indicate the value of the unknown.

* * * * *